US005303632A

United States Patent [19]

Kivity

[11] Patent Number: 5,303,632

[45] Date of Patent: Apr. 19, 1994

[54] PROJECTILE PROPELLING SYSTEM

[75] Inventor: Yosef Kivity, Haifa, Israel

[73] Assignee: The State of Israel-Ministry of Defence, Haifa, Israel

[21] Appl. No.: 814,225

[22] Filed: Dec. 23, 1991

[30] Foreign Application Priority Data

Mar. 1, 1991 [IL] Israel ..... 97388

[51] Int. Cl.[5] ..... F41F 1/00

[52] U.S. Cl. ..... 89/7; 89/8; 102/503

[58] Field of Search ..... 89/7, 8; 102/503

[56] References Cited

U.S. PATENT DOCUMENTS

| | | | |
|---|---|---|---|
| 3,253,511 | 5/1966 | Zwicky | 89/8 |
| 4,301,736 | 11/1981 | Flatau et al. | 102/503 |
| 4,495,869 | 1/1985 | Bisping | 102/503 |
| 4,539,911 | 9/1985 | Flatau | 102/503 |
| 4,579,059 | 4/1986 | Flatau | 102/503 |
| 4,938,112 | 7/1990 | Hertzberg et al. | 89/7 |

OTHER PUBLICATIONS

Wilbur et al, "The Electrothermal Ramjet", J. Spacecraft, vol. 20, No. 6, Nov.-Dec. 1983, pp. 603-610.

*Primary Examiner*—Stephen C. Bentley
*Attorney, Agent, or Firm*—Benjamin J. Barish

[57] ABSTRACT

A projectile propelling system includes a gun barrel filled with a gaseous propulsive mixture, a projectile having a front cone wall and a rear cone wall, and a driver for initially propelling the projectile in the gun barrel to an initial velocity above the detonation velocity of the gaseous propulsive mixture to produce a shock wave at the front cone wall followed by a detonation wave resulting from the reflection of the shock wave inside the barrel, which detonation wave is applied to the rear cone wall to increase the velocity of the projectile. The front cone wall and rear cone wall of the projectile are such as to create a "mach stem" in the form of a disc normal to the longitudinal axis of the projectile, of sufficiently high pressure and temperature to ensure ignition of the gaseous propulsive mixture.

15 Claims, 2 Drawing Sheets

FIG. 4
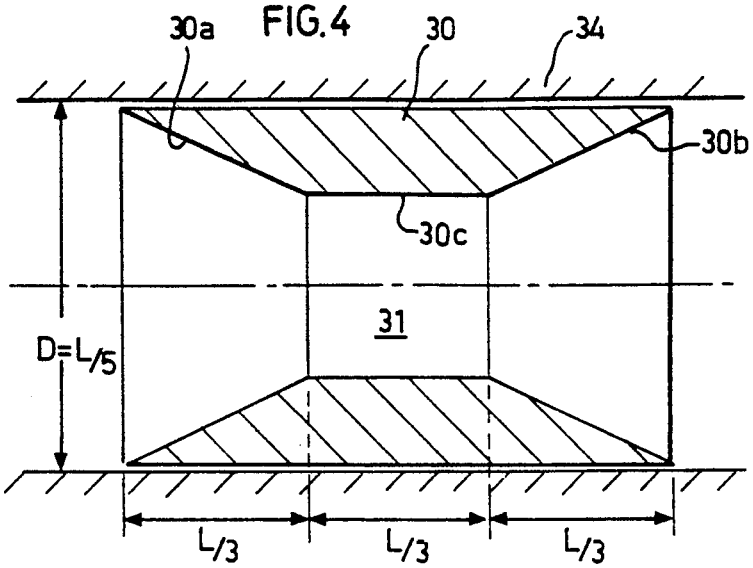
FIG. 5
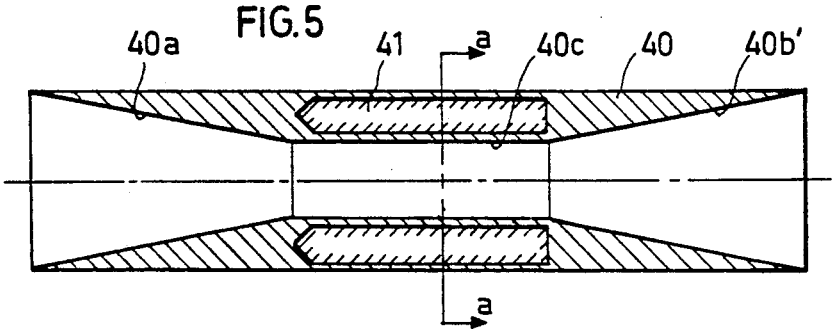
FIG 5a
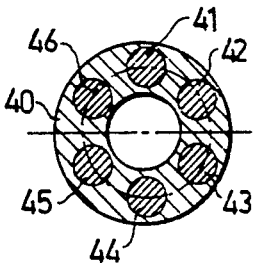
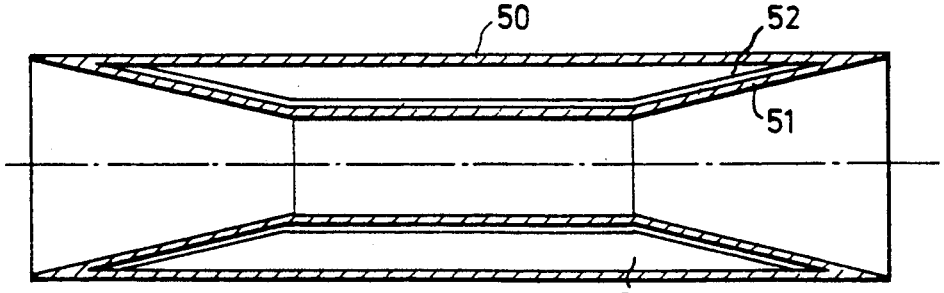
FIG. 6

PROJECTILE PROPELLING SYSTEM

FIELD AND BACKGROUND OF THE INVENTION

The present invention relates to a projectile propelling system and particularly to the RAM accelerator type of projectile propelling system.

The RAM accelerator is a recent type of projectile propelling system for accelerating heavy projectiles to hyper velocities in the range of 10 Km/s. It is based on a continuous combustion or detonation of a gaseous propulsive mixture in a gun. The gun barrel is prefilled with the mixture, and the projectile is propelled into the gun barrel and the gaseous propulsive mixture after the projectile has been accelerated by a conventional launcher, such as a light gas gun or a powder gun. The projectile is shaped in a special manner so that the flow around it creates the necessary conditions for the mixture to be detonated. The thrust is produced by the action of the high pressure of the expanding combustion or detonation products on the rear part of the projectile.

More particularly, in the RAM accelerator propelling system the driver propels the projectile in the gun barrel to an initial velocity above the detonation velocity of the gaseous propulsion mixture within the gun barrel to produce a shock wave at a front cone wall of the projectile, followed by a detonation wave applied to the rear cone wall of the projectile. The detonation wave results from the reflection of the shock wave at the barrel wall and, when applied to the rear cone wall, increases the velocity of the projectile.

This type of projectile propelling system is described in the literature, for example in Hertzberg, A, Bruckner, A. P. and Bogdanoff, D. W.: "The RAM Accelerator: A New Chemical Method of Achieving Ultrahigh Velocities", Proceedings of the 37th Meeting of the Aeroballistic Range Association, Quebec, September 1986. In the analysis given by the authors, the acceleration process comprises three main stages: (1) a preliminary acceleration stage by a conventional gun (0–0.7 Km/s); (2) an intermediate acceleration stage via a subsonic combustion process (0.7–2 Km/s); and (3) a final acceleration stage, involving detonation of the propulsive mixture.

The position of the reflected detonation wave is of critical importance to the efficiency of the RAM accelerator type projectile propelling system. Thus, if the detonation wave impinges the projectile forwardly of the rear cone wall, the high pressure of the detonation products will contribute to a drag force and will thus reduce the net thrust. On the other hand, if the detonation wave impinges the projectile too much rearwardly of the rear cone wall, then only a fraction of the rear cone area will be exposed to the high pressure gases, thereby reducing the thrust produced by the detonation wave. A difficulty in the RAM accelerator propelling system is the problem of effecting ignition of the mixture at the reflection point of the nose shock wave to obtain thrust, because this occurs only in a narrow range of projectile velocities in the conventional RAM accelerator system.

OBJECTS AND BRIEF SUMMARY OF THE INVENTION

An object of the present invention is to provide a modified RAM accelerator propelling system which better assures that the gaseous propulsive mixture will be automatically ignited at a broad velocity range, as distinguishable from the narrow velocity range in the RAM accelerator system.

According to the present invention, there is provided a projectile propelling system comprising: a gun barrel filled with a gaseous propulsive mixture, a projectile having a front cone wall and a rear cone wall, and a driver for initially propelling the projectile in the gun barrel to an initial velocity above the detonation velocity of the gaseous propulsive mixture to produce a shock wave at the front cone wall followed by a detonation wave resulting from the reflection of the shock wave inside the barrel, which detonation wave is applied to the rear cone wall to increase the velocity of the projectile; characterized in that: the projectile is of tubular configuration and is formed with an axial bore; the front cone wall of the projectile is defined by a first conical surface decreasing in diameter from the outer edge of the front end of the projectile towards the axial bore; and the rear cone wall of the projectile is defined by a second conical surface increasing in diameter from the axial bore to the outer edge of the rear end of the projectile.

As will be described more particularly below, the foregoing construction is such a to create, in the produced shock wave, a "mach stem" in the form of a disc normal to the longitudinal axis of the projectile, of sufficiently high pressure and temperature to ensure ignition of the gaseous propulsion mixture. This construction therefore better assures that the gaseous propulsive mixture will be detonated at the precise time when the projectile is correctly positioned in the barrel to maximize the acceleration produced by the combustion products.

According to a further important feature in the preferred embodiments of the invention described below, the projectile further includes a cylindrical section of uniform diameter between the first and second conical surfaces. Such a construction better assures that the intersection point of the detonation wave and projectile is such as to maximize the acceleration produced by the combustion products.

Further features and advantages of the invention will be apparent from the description below.

BRIEF DESCRIPTION OF THE DRAWINGS

The invention is herein described, by way of example only, with reference to the accompanying drawings, wherein:

FIG. 4 illustrates a projectile constructed in accordance with another preferred embodiment of the present invention; and FIGS. 5 and 6 schematically illustrate projectiles constructed in accordance with further embodiments of the present invention.

DESCRIPTION OF PREFERRED EMBODIMENTS

Figure 1:
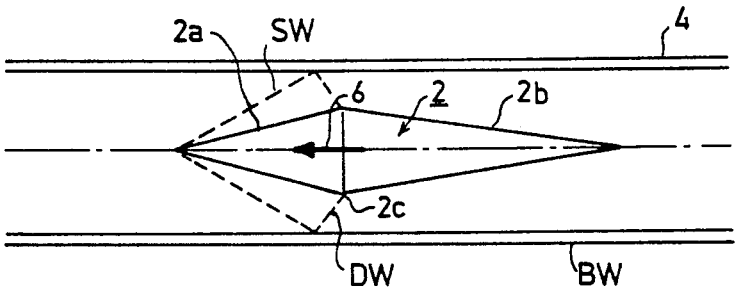
FIG 1 (PRIOR ART)
FIG. 1 schematically illustrates the thrust produced by the known RAM accelerator type of projectile propelling system; according to one (the oblique) detonation mode.

In FIG. 1, which illustrates the thrust produced by the RAM accelerator type of projectile in the oblique detonation mode, the projectile, generally designated 2, is shown as moving through the gun barrel 4 in the direction of the arrow 6. The projectile 2 consists of a center body with stabilizing fins (not shown for purposes of clarity) to center the projectile along the axis of symmetry. The gun barrel 4 is filled with a gaseous propulsive mixture in which a detonation wave would propagate provided the appropriate thermal dynamic conditions for initiating the detonation of the mixture prevail within the gun barrel.

The projectile 2 includes a front cone wall 2*a* and a rear cone wall 2*b*. A driver (not shown in FIG. 1) propels the projectile into the gun barrel 4 to an initial velocity above the detonation velocity of the gaseous propulsion mixture. This produces a shock wave SW at the front cone wall 2*a*, followed by a detonation wave DW resulting from the reflection of the shock wave at the barrel wall. This detonation wave DW is applied to the rear cone wall 2*b* of the projectile to increase the velocity of the projectile.

Rarefaction waves may be necessary to turn the flow as required by boundaries. As an example, if the flow velocity downstream of the detonation wave DW is pointed inwards, a centered rarefaction wave emanating from the reflection point at the barrel wall is required. Another rarefaction wave, centered at the shoulder 2*c* of the projectile deflects the flow to conform to the direction of the rear cone wall 2*b*. For simplicity purposes, the rarefaction waves are not shown in FIG. 1.

Figure 2:
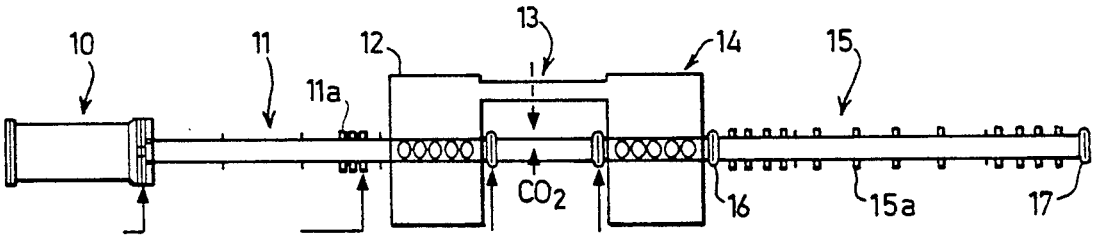
FIG 2 (PRIOR ART)
FIG. 2 schematically illustrates the essential elements in the known RAM accelerator type of projectile propelling system.

FIG. 2 illustrates a complete projectile propelling system as described in the above-cited publication. It includes a driver 10, a launch tube 11, a helium (He) dump tank 12, a sabot stripper 13, a carbon dioxide ($CO_2$) dump tank 14, and a RAM accelerator section 15 filled with a gaseous propulsive mixture (such as one of the known mixtures including methane, oxygen and/or carbon dioxide) and closed at its opposite ends by diaphragms 16 and 17. Further details of the construction and operation of such a projectile propelling system are described in the above-cited publication.

As indicated earlier, the position of the reflected detonation wave DW, as illustrated in FIG. 1, is of critical importance to the efficiency of the system. Thus, if the detonation wave DW impinges the projectile ahead of shoulder 2*c*, the high pressure of the detonation products will produce a drag force and will thus reduce the net thrust. On the other hand, if the detonation wave DW impinges behind shoulder 2*c*, then only a fraction of the rear cone area 2*b* will be exposed to the high pressure gases, and the thrust will therefore be below its full potential value.

Figure 3:
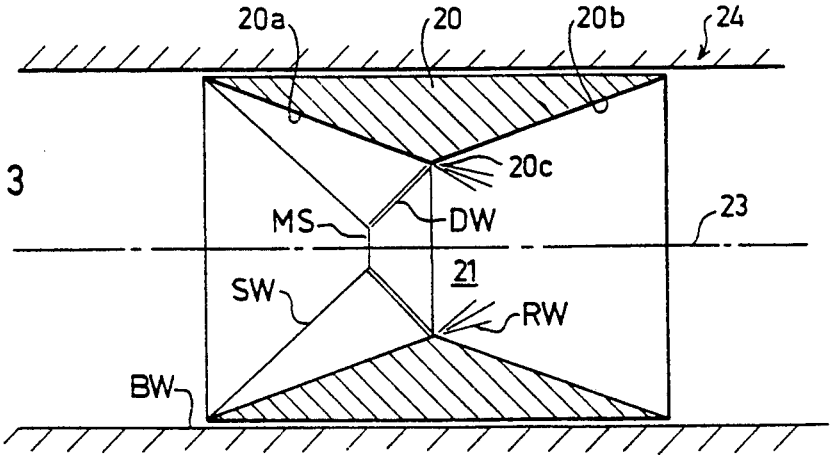
FIG. 3 schematically illustrates the projectile, and the wave system, according to one embodiment of the present invention.

FIG. 3 illustrates a construction of the projectile in order to better assure that the gaseous propulsive mixture will be automatically ignited at a broad velocity range, as distinguished from the narrow velocity range in the RAM accelerator system.

For this purpose, the projectile, generally designated 20 in FIG. 3, is of tubular configuration and is formed with an axial bore 21. The front cone wall of the projectile is defined by a first conical surface 20*a* decreasing in diameter from the outer edge of the front end of the projectile towards its axial bore 21; and the rear cone wall of the projectile is defined by a second conical surface 20*b* increasing in diameter from the axial bore to the outer edge of the rear end of the projectile. The juncture of the two conical surfaces 20*a*, 20*b*, is indicated by shoulder 20*c* in FIG. 3.

By thus making the projectile of tubular configuration, with above-described "inverted" conical cross-sections defining the front and rear cone walls as illustrated in FIG. 3, the motion of the projectile in the barrel 24 creates a conically converging shock wave whose strength (i.e., the pressure behind it) increases as it approaches the axis of symmetry 23 of the projectile, which axis of symmetry coincides with the axis of symmetry of the gun barrel 24. The strength of such converging shock waves increases very rapidly as they approach the axis of symmetry 23, until they reach a level whereby a regular oblique reflection is not possible. Consequently, a phenomenon, termed "mach reflection" occurs.

The shock wave system in the case of such a "mach reflection" is illustrated in FIG. 3. Thus, it consists of: (1) the incident converging oblique shock wave (SW); (2) a "mach stem" (MS) in the form of a small disc normal to the axis of symmetry 23; and (3) a diverging, reflected detonation (DW). This triple wave system also requires a slip stream. A slip stream is not shown in FIG. 3 for the sake of simplicity, as it has no bearing on the construction of the projectile, or of the projectile propelling system, in accordance with the present invention.

The entire shock wave system as illustrated in FIG. 3 moves with the projectile 20 when a steady state flow is established. This permits evaluation of the temperature behind the "mach stem" (MS), using well-known relations for normal shock waves; see for example "Equations, Tables, and Charts for Compressible Flow" NACA Report 1135, by AMES Research Staff (1953) Page 7, Eq. (95).

The temperature behind the mach stem MS may thus be denoted as "Tm", and the temperature in the undisturbed gas mixture as "To". Assuming a typical gas mixture with a specific heat ratio of 1.4, the following relation is established:

$$Tm/To=(7M^2-1)(M^2+5)/36M^2$$

where M is the Mach Number of the flow relative to the "mach stem", which equals the ratio between the projectile speed and the local speed of sound.

As an example, consider a projectile at a speed of 2000 m/s, moving in a mixture with a speed of sound of $\approx$330 m/s. In this case M=6 and Tm=2380 ° K. This is a sufficiently high temperature to ensure ignition in all the common detonative gas mixtures.

It is of interest to compare this value with the temperature rise obtained in the original RAM accelerator configuration, e.g., as illustrated in FIG. 1. A calculation pertaining to the wave system in the FIG. 1 RAM accelerator shows that the temperature behind the reflected wave at the gun barrel is only about 570° K., much lower than the ignition temperature of a typical detonative gas mixture.

To obtain the shortest possible launcher, the ballistic efficiency of the propulsion cycle has to be kept at optimum level over the entire length of the barrel. To achieve this, the detonation wave has to hit the projectile at the shoulder 20*c* in order to maximize the thrust delivered by the high pressure detonation products.

However, the intersection point of the detonation wave and the projectile depends on the geometry of the wave system. As the projectile velocity increases, the angles of both the detonation and the nose waves become shallower, so that if the projectile and barrel are kept unchanged, the intersection point will move backwards on the projectile. This would have a detrimental effect on the efficiency of the cycle.

To mitigate this effect, a cylindrical midsection is added to the projectile in the construction illustrated in FIG. 4. Thus, FIG. 4 illustrates the tubular projectile 30 as being formed, between its front conical surface 30*a* and rear conical surface 30*b*, with a cylindrical midsection 30*c* of uniform diameter. The cylindrical midsection 30*c* is sufficiently long such that the intersection point of the detonation wave and projectile stays within its limits for the design velocity range.

As one example, the axial lengths of the cylindrical midsection 30*c*, the front conical section 30*a*, and the rear conical section 30*b* are substantially equal, each being approximately one-third of the axial length of the projectile. In addition, the total axial length of the projectile 30 is approximately five times the diameter of the gun barrel 34.

The gaseous propulsive mixture included in the gun barrel may be of any of the known compositions. Following are the detonation properties of typical mixtures: (Temp. = 300° K., Press. = 1 MPa)

| MIXTURE COMPOSITION | DETONATION VELOCITY Km/s | COLD GAMMA | HOT GAMMA | HEAT OF REACTION MJ/Kg | SOUND SPEED Km/s |
|---|---|---|---|---|---|
| $2H_2 + O_2$ | 2.963 | 1.40 | 1.202 | 9.82 | 0.540 |
| $H_2$ + AIR | 1.987 | 1.40 | 1.216 | 3.59 | 0.406 |
| $CH_4 + O_2$ | 2.492 | 1.359 | 1.206 | 6.78 | 0.356 |
| $CH_4$ + AIR | 1.816 | 1.387 | 1.247 | 2.91 | 0.354 |

FIGS. 5 and 6 illustrate two possible applications of the invention.

In FIG. 5, there is illustrated a projectile, generally designated 40, of tubular shape and also including the cylindrical midsection 40*c* between the front conical surface 40*a* and the rear conical surface 40*b*, as described above particularly with reference to FIG. 4. The projectile further includes a plurality of independent vehicles 41–46 disposed in a circular array around the projectile body. The tubular shape of the projectile 40 is particularly suited to the circular array of the independent vehicles within the projectile body.

FIG. 6 illustrates the projectile as included in an armor penetrator. In this case, the inner surface of the tubular projectile, generally designated 50, is actually a metallic liner, as shown at 51, wrapped by a shaped high explosive charge 52. The projectile further includes an electronics package and initiation system, as schematically indicated at 53. Before hitting the armor target, the explosive is detonated thereby forming a long rod penetrator, or a segmented rod penetrator, which produces a superior penetration capability.

While the invention has been illustrated with respect to several preferred embodiments in which the conical surfaces defining the front and rear cone walls are straight cones, i.e., their longitudinal sections are straight lines as shown in FIGS. 3–6, these conical surfaces may also have some curvature in the longitudinal section. Many other variations, modifications and applications of the invention may also be made.

What is claimed is:

1. A projectile propelling system, comprising: a gun barrel filled with a gaseous propulsive mixture, a projectile having a front cone wall and a rear cone wall, and a driver for initially propelling the projectile in the gun barrel to an initial velocity above the detonation velocity of the gaseous propulsive mixture to produce a shock wave at the front cone wall followed by a detonation wave resulting from the reflection of the shock wave inside the barrel, which detonation wave is applied to the rear cone wall to increase the velocity of the projectile; characterized in that:

said projectile is of tubular configuration and is formed with an axial bore;

said front cone wall of the projectile is defined by a first conical surface decreasing in diameter from the outer edge of the front end of the projectile towards said axial bore; and said rear cone wall of the projectile is defined by a second conical surface increasing in diameter from the axial bore to the outer edge of the rear end of the projectile;

said front and rear conical surfaces of the projectile being effective to create, in the produced shock wave, a "mach stem" in the form of a disc normal to the longitudinal axis of the projectile, of sufficiently high pressure and temperature to ensure ignition of the gaseous propulsive mixture.

2. The system according to claim 1, wherein said projectile further includes a cylindrical section of uniform diameter between said first and second conical surfaces.

3. The system according to claim 2, wherein the axial lengths of said cylindrical section, first conical surface, and second conical surface, are equal to each other.

4. The system according to claim 2, wherein the axial length of the projectile is five times the diameter of the gun barrel.

5. The system according to claim 1, wherein said projectile includes an independent vehicle.

6. The system according to claim 5, wherein said projectile includes a plurality of independent vehicles disposed in an annular array within the projectile.

7. The system according to claim 1, wherein said projectile includes a shaped explosive charge which is detonated before the projectile hits the target to form a rod-like penetrator and thus to increase the penetration capability of the projectile.

8. The system according to claim 7, wherein the inner surface of the projectile includes a metallic liner wrapped by said shaped explosive charge.

9. A projectile propelling system, comprising:

a gun barrel filled with a gaseous propulsive mixture, a projectile having a front cone wall and a rear cone wall, and a driver for initially propelling the projectile in the gun barrel to an initial velocity above the detonation velocity of the gaseous propulsive mixture to produce a shock wave at the front cone wall followed by a detonation wave resulting from the reflection of the shock wave inside the barrel, which detonation wave is applied to the rear cone wall to increase the velocity of the projectile;

said projectile being of tubular configuration and being formed with an axial bore;

said front cone wall of the projectile being defined by a first conical surface decreasing in diameter from the outer edge of the front end of the projectile towards said axial bore;

said rear cone wall of the projectile being defined by a second conical surface increasing in diameter from the axial bore to the outer edge of the rear end of the projectile;

said projectile further including a cylindrical section of uniform diameter between said first and second conical surfaces;

said front and rear conical surfaces of the projectile being effective to create, in said cylindrical section, a "mach stem" in the form of a disc normal to the longitudinal axis of the projectile, of sufficiently high pressure and temperature to ensure ignition of the gaseous propulsive mixture.

10. The system according to claim 9, wherein the axial lengths of said cylindrical section, first conical surface, and second conical surface, are equal to each other.

11. The system according to claim 9, wherein the axial length of the projectile is five times the diameter of the gun barrel.

12. The system according to claim 9, wherein said projectile includes an independent vehicle.

13. The system according to claim 12, wherein said projectile includes a plurality of independent vehicles disposed in an annular array within the projectile.

14. The system according to claim 1, wherein said projectile includes a shaped explosive charge which is detonated before the projectile hits the target to form a rod-like penetrator and thus to increase the penetration capability of the projectile.

15. The system according to claim 14, wherein the inner surface of the projectile includes a metallic liner wrapped by said shaped explosive charge.

* * * * *